US005828276A

United States Patent [19]

Kurono et al.

[11] Patent Number: 5,828,276

[45] Date of Patent: Oct. 27, 1998

[54] MOLDED-CASE MULTICIRCUIT BREAKERS

[75] Inventors: Toru Kurono, Seto; Hideaki Hayashi, Owariasahi, both of Japan

[73] Assignee: Nitto Electric Works, Ltd., Aichi-ken, Japan

[21] Appl. No.: 589,596

[22] Filed: Jan. 22, 1996

[51] Int. Cl.[6] ..... H01H 75/12

[52] U.S. Cl. ..... 335/35; 335/7; 218/22

[58] Field of Search ..... 335/8–10, 23–35, 335/167–76, 16, 147, 195; 218/22

[56] References Cited

U.S. PATENT DOCUMENTS

| | | | |
|---|---|---|---|
| 2,661,414 | 12/1953 | Casey | 335/35 |
| 3,264,435 | 8/1966 | Klein et al. | 335/23 |
| 3,526,861 | 9/1970 | Walker | 335/16 |
| 3,997,857 | 12/1976 | Wien et al. | 335/35 |

*Primary Examiner*—Lincoln Donovan
*Attorney, Agent, or Firm*—Frishauf, Holtz, Goodman, Langer & Chick

[57] ABSTRACT

A molded-case multicircuit breaker which suffers insufficient contact pressure at no poles and which is free from damage. The molded-case multicircuit breaker having at least two circuits comprises a handle which performs on-off operation of the circuits simultaneously, a first finger having a movable contact for a first circuit, and another finger having a movable contact for a circuit other than the first circuit, wherein the first finger is designed to be switched on and off directly by the handle, and the finger for a circuit other than the first circuit is electrically insulated from the first finger and is attached resiliently to the first finger. The second finger may be pivotally attached or spring loaded to the first finger.

3 Claims, 5 Drawing Sheets

MOLDED-CASE MULTICIRCUIT BREAKERS

BACKGROUND OF THE INVENTION

1. Field of the Invention

The present invention relates to a molded-case multicircuit breaker having a plurality of fingers (movable contacts) which are operated by a single handle.

2. Description of the Related Art

For example, in a prior art molded-case two-circuit breaker in which two circuits are adapted to be switched on and off simultaneously, two fingers 22, 23 are attached independently to a lower portion of a handle 21 and are connected to each other by a resin plate 24 having excellent insulating property, and the resin plate 24 is caught at the middle by the lower tail end of a spring 25, as shown in FIG. 1. In this structure, these two fingers 22, 23 are designed to be operated simultaneously by the single handle 21.

In such prior art molded-case two-circuit breaker as shown in FIG. 1, force of the spring 25 is designed to be transmitted via the resin plate 24 to the fingers 22, 23 having movable contact 22*a* and 23*a* respectively, when the handle 21 is pulled to the ON side, to press the fingers 22, 23 strongly against fixed contacts respectively. However, in such structure, these fingers 22, 23 are likely to be distorted to provide uneven contact pressures between two contact pairs (each pair consisting of a fixed contact and a movable contact), and thus it can happen that one contact pair comes to have insufficient contact pressure. Specifically, if the finger 22 is distorted to protrude toward the fixed contact compared with the finger 23, contact between the finger 23 and the fixed contact is hindered by the finger 22. Accordingly, the contact pressure of the finger 23 becomes smaller than that of the finger 22. Furthermore, in the prior art molded-case multicircuit breaker, it is likely that torsional stress concentrates on the joint of the metal fingers 22, 23 with the resin plate 24 to break the resin plate 24 at the joint.

SUMMARY OF THE INVENTION

It is an objective of the present invention to provide a molded-case multicircuit breaker having overcome the problems inherent in the prior art as described above, which suffers insufficient contact pressure at no contact pair and which is free from damage inside.

The present invention, which was accomplished for the purpose of overcoming the problems described above, provides a molded-case multicircuit breaker having a plurality of fingers (e.g., two fingers) which are simultaneously operated by a single handle for performing on-off switching of a plurality of circuits (e.g., two circuits), characterized in that a first movable contact is directly fixed to a first finger, and a second movable contact is fixed to a second finger and that the second finger is resiliently attached to the first finger via an insulating material so as to be insulated from the first movable contact.

According to the molded-case multicircuit breaker of the present invention, a plurality of fingers are operated by a single handle to switch on and off simultaneously a plurality of circuits like in the prior art. However, in the present invention, since the second finger is attached resiliently to the first finger (to be electrically insulated therefrom), the movable contact of each finger is not hindered by the other finger but can be brought into contact with a corresponding fixed contact with sufficient contact pressure. In addition, no torsional force is applied to the joint of the fingers unlike in the prior art, so that liability to damage can be eliminated.

BRIEF DESCRIPTION OF THE DRAWINGS

The features of the present invention that are believed to be novel are set forth with particularity in the appended claims. The invention, together with the objects and advantages thereof, may best be understood by reference to the following description of the presently preferred embodiments taken in conjunction with the accompanying drawings in which:

FIG. 2(*b*) is a cross-sectional view taken along the line 2B—2B of FIG. 2*a* as viewed from the right;

FIG. 4(*b*) is an exploded perspective view of the major section of the molded-case multicircuit breaker shown in FIG. 2 illustrating the mutual relationship between the handle and two fingers;

FIG. 5(*b*) is a cross-sectional view taken along the line 5B—5B of FIG. 5(*a*) as viewed from the right; and FIG. 5(*c*) is a cross-sectional view taken along the line 5C—5C of FIG. 5(*b*) as viewed from the left.

DESCRIPTION OF THE PREFERRED EMBODIMENTS

The molded-case two-circuit two-contact breaker according to the present invention will be described below in more detail by way of preferred embodiments.

Figure 1:
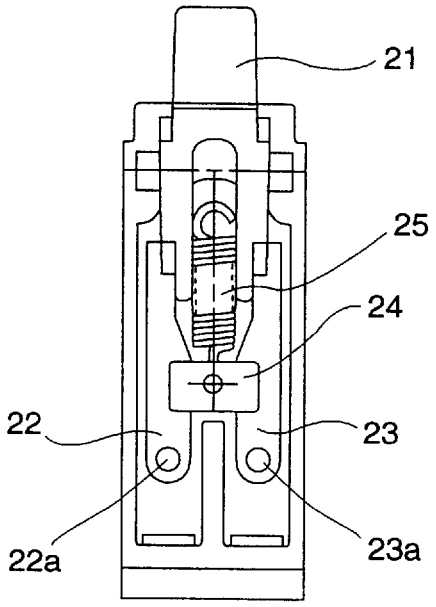
Fig. 1 (PRIOR ART)
FIG. 1 is a cross-sectional view of a prior art molded-case multicircuit breaker.
Figure 2:
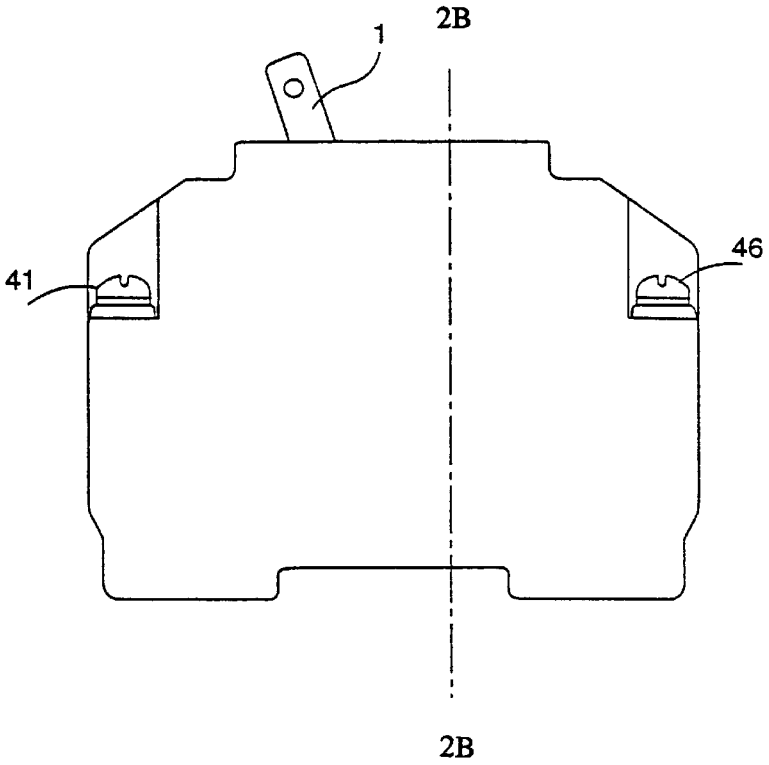
FIG. 2(*a*) shows, in side view, appearance of the molded-case multicircuit breaker having two switching circuits according to a first embodiment of the present invention.
Figure 2:
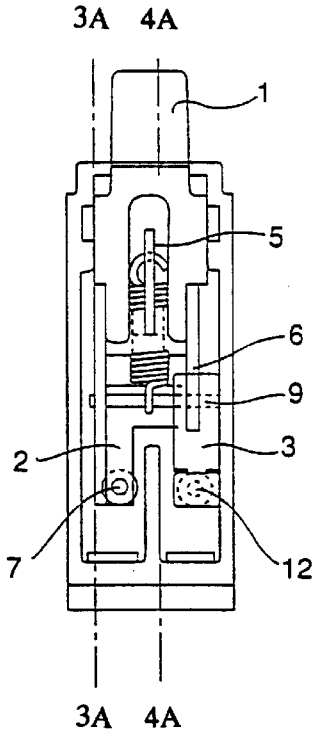
Figure 3:
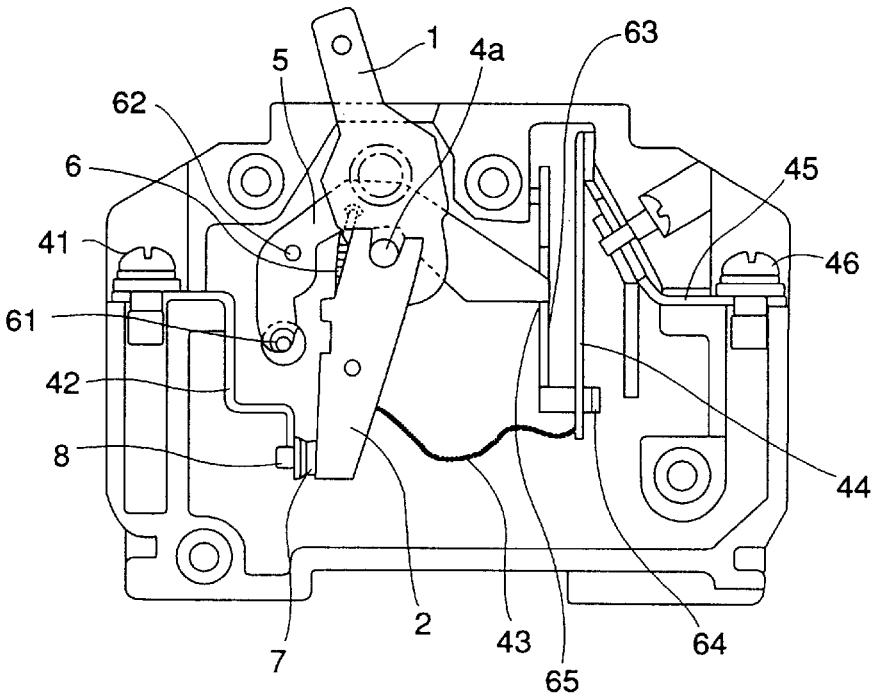
FIGS. 3(*a*) and 3(*b*) are cross-sectional views of the molded-case multicircuit breaker shown in FIG. 2 taken along the line 3A—3A of FIG. 2(*b*) as viewed from the left; in which FIG. 3(*a*) shows a state of a first switching circuit where the handle is switched to the ON position, and FIG. 3(*b*) shows a state of the first switching circuit where the handle is switched to the OFF position.
Figure 3:
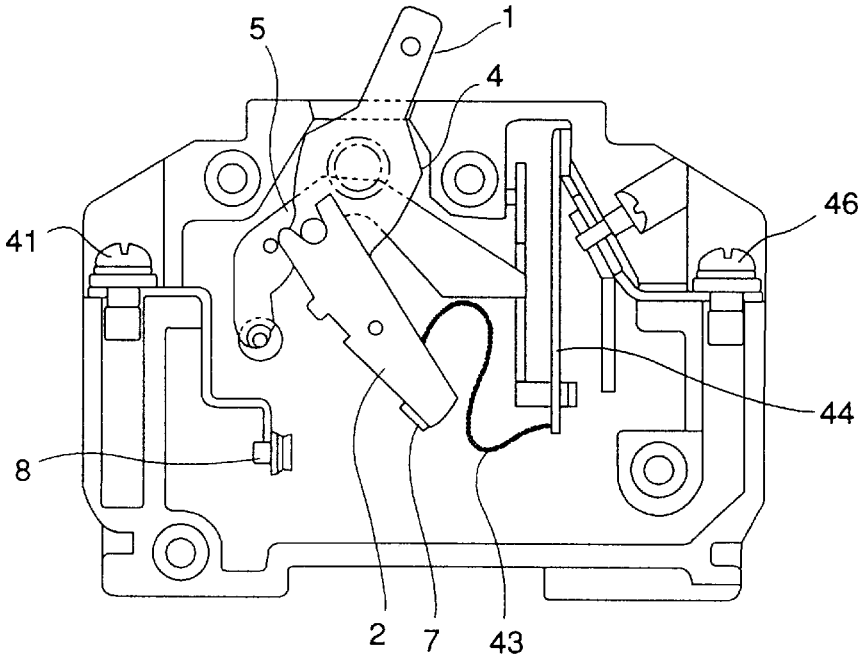
Figure 4:
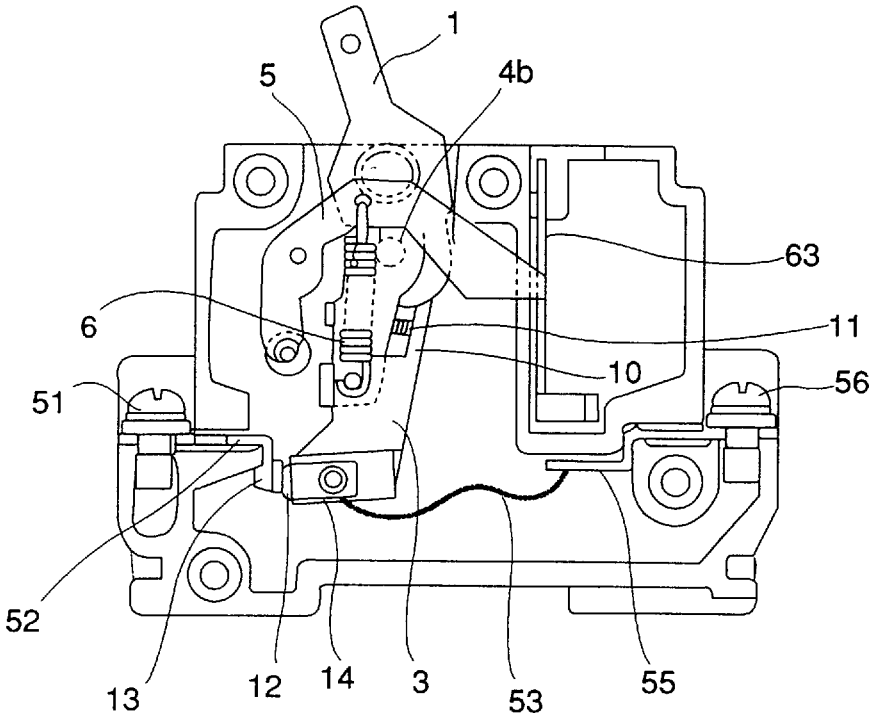
FIG. 4(*a*) is a cross-sectional view of the molded-case multicircuit breaker shown in FIG. 2 taken along the line 4A—4A of FIG. 2(*b*) as viewed from the left, showing a state of a second switching circuit where the handle is switched to the ON position.
Figure 4:
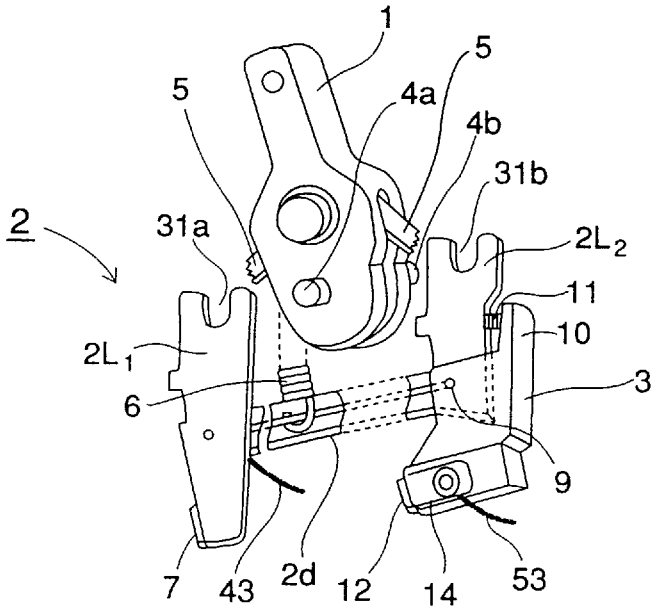

FIGS. 2 to 4 show a first embodiment of the present invention: FIGS. 2(*a*) shows appearance of the breaker in side view; FIG. 3 shows a cross-sectional view of a first circuit of the breaker, (a) assuming an ON state and (b) assuming an OFF state; FIG. 4(*a*) shows a cross-sectional view of a second circuit assuming an ON state; and FIG. 4(*b*) illustrates in exploded perspective view mutual relationship between a handle and two fingers and their structure. In these drawings, the reference number 1 denotes a handle; 2 a first finger, corresponding to a first circuit, made of a conductive material; and 3 a second finger, corresponding to a second circuit, made of an insulating material.

As shown in FIG. 4(*b*), the first finger 2 is composed of a $2L_1$ portion and a $2L_2$ portion, which are connected to each other parallelwise by a connecting bar 2*d* made of a conductive material (which is shown partially cut-away) to constitute an integral body. A movable contact 7 is directly fixed to the lower part of the $2L_1$ portion. Meanwhile, the $2L_2$ portion is shorter than the $2L_1$ portion and ends in around the connecting bar 2*d*. The second finger 3 made of an insulating material is pivotally attached by a pin 9 to the lower part of the first finger 2 and is urged clockwise by a spring 11. It should be noted that these schemata are only explanatory and this invention is not limited to these schemata.

A conductive block 14 is attached to the lower end of the second finger 3, and a movable contact 12 is fixed to the left side face of the block 14. Accordingly, while the movable contact 7 of the first circuit is fixed directly to the $2L_1$ portion of the first finger 2 made of a conductive material, the movable contact 12 of the second circuit is fixed to the second finger 3 made of an insulating material which is pivotally attached with resilience to the first finger 2. Incidentally, the $2L_1$ portion of the first finger 2 may be allowed to have the same structure as that of the $2L_2$ portion, and a second finger made of an insulating material may be pivotally attached with resilience to the first finger on the first circuit side like on the second circuit side.

The $2L_1$ portion and the $2L_2$ portion of the first finger 2 have U-shaped slits 31*a*, 31*b* at the upper end portions respectively, and these slits 31*a*, 31*b* are designed to be engaged with shafts 4*a*, 4*b* protruding from the lower front and rear surfaces of the handle 1 respectively. The first finger 2 is adapted to perform well-known toggle switching movement by the handle 1 with the aid of the tensile force of a spring 6 extended between a cradle 5 and the pin 9 of the first finger 2. Accordingly, when the handle 1 is pulled to the ON side, the movable contact 7 of the first circuit is brought into contact with the fixed contact 8, as shown in FIG. 3(*a*).

Thus, a conductive circuit starting from a terminal 41 of the first circuit of the two-circuit breaker, through a conductor 42, the fixed contact 8, the movable contact 7, $2L_1$ portion of the first finger 2, a flexible conductor stranded wire 43, a bimetal 44, a conductor 45 to a terminal 46 is completed to allow the first circuit to assume an ON state.

Meanwhile, the second finger 3 which is made of an insulating material (e.g., synthetic resin) is pivotally attached at an upper position to the first finger 2 by the pin 9. As shown in FIG. 4(*b*), the second finger 3 has an arm 10 extended upward, and a spring 11 is interposed between the arm 10 and the first finger 2. The second finger 3 is resiliently urged by the force of the spring 11 to be turned on the pin 9 clockwise in FIGS. 4(*a*) and 4(*b*), so that the movable contact 12 fixed to a conductive block 14 located at the lower end of the second finger 3 can be brought into contact with a fixed contact 13.

Thus, a conductive circuit starting from a terminal 51 of the second circuit, through a conductor 52, the fixed contact 13, the movable contact 12, the conductive block 14, the flexible conductor stranded wire 53 and a conductor 55 to a terminal 56 is completed to allow the second circuit to assume an ON state.

Incidentally, a cradle 5 shown in FIGS. 3(*a*), 3(*b*) and 4(*a*) is means which trips when an electric current exceeding a predetermined current value flows across the bimetal 44 to effect switching of the breaker from the ON state to the OFF state. The cradle 5 is pivotally supported by a pin 61 on the left end portion, and the right end portion is engaged with a notch 65 formed around the center of an elastic body 63 fixed at an upper position.

The bimetal 44 bends when an electric current flowing across the bimetal exceeds the predetermined value to turn counterclockwise on the fixed upper end portion. Then, the lower end portion 64 of the elastic body 63 is pushed by the thus bent bimetal 44 to be turned counterclockwise, and the notch 65 shifts rightward, so that the right end portion of the cradle 5 escapes from the notch 65. The thus escaped cradle 5 turns clockwise on the pin 61 to move the first finger 2 (together with the second finger 3) to the OFF position at a shifted toggle fulcrum.

As described above, the tripping means which is actuated by excess electric current is well known in the art, and the breaker according to the present invention is not limited to such means. In other words, the present invention can be applied to multicircuit breakers irrespective of the presence or absence of tripping function executed under excess current.

While, a first finger 2 and a second finger 3 which are operated by a single handle 1 for two-circuit breaker is illustrated in FIG. 4(*b*), the present invention can be embodied in a three-circuit breaker for a three-phase alternating current power supply circuit if a third finger like the second finger 3 is additionally disposed in parallel.

As described above, since the second finger 3 is resiliently attached to the first finger 2, one finger is not hindered by the other finger from contacting with the corresponding fixed contact unlike in the prior art, and the fingers 2, 3 can be brought into contact with the fixed contacts 8, 13 respectively with uniform contact pressure under the force of the powerful spring 6. Accordingly, no pole comes to have insufficient contact pressure. Further, no excessive torsional force is acted upon the joint between the first finger 2 and the second finger 3 unlike in the prior art, so that liability to damage can be also eliminated.

Figure 5:
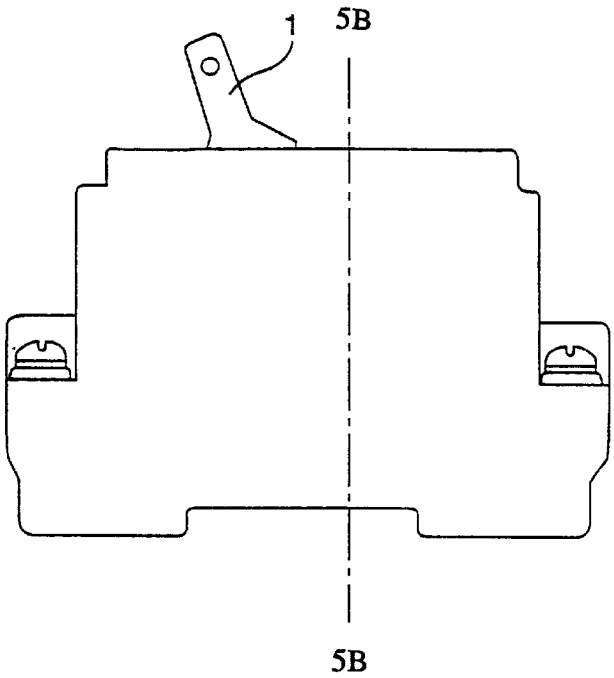
FIG. 5(*a*) shows, in side view, appearance of the molded-case multicircuit breaker according to a second embodiment of the present invention.
Figure 5:
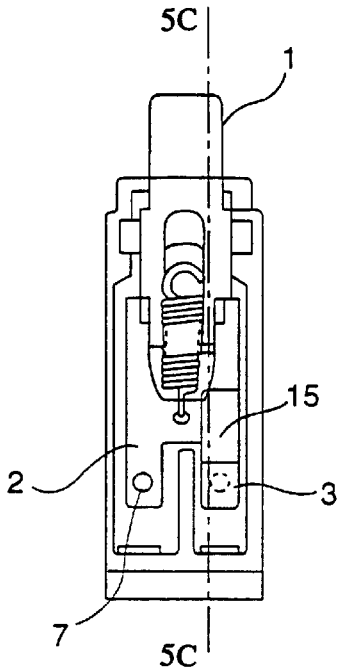
Figure 5:
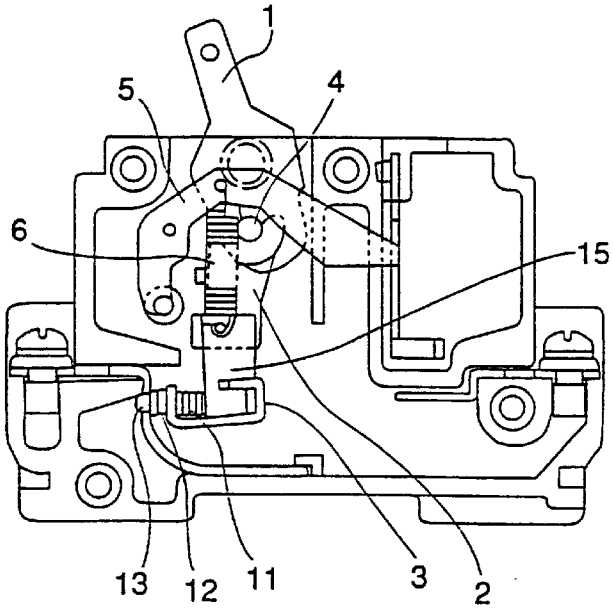

According to a second embodiment of the invention shown in FIG. 5, a synthetic resin insulator 15 is fixed to the lower part of the first finger 2, and the second finger 2 is spring loaded to the insulator 15. The second finger 3 is normally urged forward by the resilience of the spring 11 interposed between the insulator 15 and the second finger 3 to bring the movable contact 12 provided on the lower part of the second finger 3 into contact with the fixed contact 13 of the second circuit.

In the second embodiment again, the fingers 2, 3 can be brought into contact with the fixed contacts 8, 13 respectively with uniform contact pressure like in the first embodiment to cause no insufficiency in the contact pressure. Further, there is no fear of damage at the joint of the first finger 2 and the second finger 3. It should be noted here that the second finger 3 is spring loaded to the $2L_2$ portion of the first finger 2 in the above embodiment, the $2L_1$ portion of the first finger 2 may be allowed to have the same shape as that of the $2L_2$ portion and another spring loaded finger may be attached to the $2L_1$ portion.

Merits of this invention are, as described above, that no pole comes to have insufficient contact pressure and that there is no liability to damage at the joint of the fingers, because the second finger infra are resiliently attached to the first finger. Therefore, the molded-case multipolar breaker according to the present invention is valued high as a breaker having overcome the problems inherent in the prior art.

Although only two embodiments of the present invention have been described herein, it should be apparent to those skilled in the art that the present invention may be embodied in many other specific forms without departing from the spirit or scope of the invention. Therefore, the foregoing embodiments are to be considered as illustrative and not restrictive, and the invention is not to be limited to the details given herein, but may be modified within the scope of the appended claims.

What is claimed is:

1. A molded-case multicircuit breaker having at least two circuits which are on-off operated by a single handle, comprising:

a handle;

a first finger having a movable contact for a first circuit;

another finger having a movable contact for a circuit other than said first circuit;

wherein said first finger is designed to be switched on and off directly by said handle, and said finger for a circuit other than said first circuit is electrically insulated from said first finger and is attached resiliently to said first finger.

2. The molded-case multicircuit breaker according to claim 1, wherein said finger other than said first finger is pivotally attached to said first finger.

3. The molded-case multicircuit breaker according to claim 1, wherein said finger other than said first finger is spring loaded to said first finger.

* * * * *